United States Patent [19]

Kageyama

[11] Patent Number: 5,009,533

[45] Date of Patent: Apr. 23, 1991

[54] PROPELLING PENCIL WITH CUSHION SLEEVE

[75] Inventor: Hidehei Kageyama, Kawagoe, Japan

[73] Assignee: Kotobuki & Co., Ltd., Kyoto, Japan

[21] Appl. No.: 565,214

[22] Filed: Aug. 9, 1990

Related U.S. Application Data

[63] Continuation of Ser. No. 346,344, Apr. 28, 1989, abandoned, which is a continuation of Ser. No. 695,755, Jan. 29, 1985, abandoned, which is a continuation of Ser. No. 410,963, Aug. 24, 1982, abandoned.

[30] Foreign Application Priority Data

May 10, 1982 [JP] Japan ..... 57-67850

[51] Int. Cl.[5] ..... B43K 21/00; B43K 21/22

[52] U.S. Cl. ..... 401/65; 401/54; 401/94

[58] Field of Search ..... 401/54, 65, 67, 94, 401/214

[56] References Cited

U.S. PATENT DOCUMENTS

| | | | |
|---|---|---|---|
| 3,864,046 | 2/1975 | Butka | 401/67 X |
| 3,917,418 | 11/1975 | Lanoie | 401/54 X |
| 3,947,133 | 3/1976 | Kageyama et al. | 401/54 |
| 4,171,170 | 10/1979 | Kageyama et al. | 401/54 X |
| 4,240,759 | 12/1980 | Matsumoto et al. | 401/94 X |
| 4,371,277 | 2/1983 | Kageyama et al. | 401/65 X |
| 4,386,865 | 6/1983 | Kageyama et al. | 401/54 X |

FOREIGN PATENT DOCUMENTS

| | | | |
|---|---|---|---|
| 926054 | 7/1949 | Fed. Rep. of Germany | 401/214 |
| 1090138 | 9/1960 | Fed. Rep. of Germany | 401/67 |
| 2117164 | 10/1972 | Fed. Rep. of Germany | 401/65 |
| 995271 | 11/1951 | France | 401/214 |
| 1002939 | 3/1952 | France | 401/214 |
| 1252736 | 12/1960 | France | 401/214 |

*Primary Examiner*—Steven A. Bratlie

*Attorney, Agent, or Firm*—Sherman and Shalloway

[57] ABSTRACT

A knock-type propelling pencil includes a lead pipe inserted into an outer cylinder and having a lead chuck at the end portion thereof, a chuck-fastening tube for fastening the lead chuck, a cushion sleeve coming into contact with the chuck-fastening tube and being slidable relative to the outer cylinder, and being urged by a spring. The cushion sleeve has a cushion portion which can be resiliently deformed to absorb excessive writing pressure and thereby preventing breaking of the lead.

5 Claims, 4 Drawing Sheets

PROPELLING PENCIL WITH CUSHION SLEEVE

This application is a continuation, of application Ser. No. 07/346,344 filed Apr. 28, 1989 which is a continuation of Ser. No. 06/695,755 filed 1/29/85 which is a continuation of Ser. No. 06/410,963 filed 8/24/82 all abandoned.

BACKGROUND OF THE INVENTION

This invention relates to a knock-type propelling pencil, and more specifically relates to such a propelling pencil as which prevents breaking of a lead by resiliently absorbing the force transferred to the lead when an excessive pressure is applied to the pencil lead.

A conventional propelling pencil as shown in FIG. 1 has heretofore been proposed, in which structure to prevent breaking of a lead has been provided.

In FIG. 1, reference numeral 1 is a holder, reference numeral 2 is a lead storing cylinder which is inserted into the holder 1 slidably in the direction of the holder axis, reference numeral 3 is a lead chuck fixed in the tip of the lead storing cylinder 2, reference numeral 4 is a chuck ring loosely fitted to the tip of the lead chuck 3. Further, reference numeral 5 is a sleeve disposed between the chuck ring 4 and the holder 1 and slidably inserted into the lead chuck 3, and in the rear portion of the sleeve 5, a spring 7 is disposed between the rear portion and the stopper 8 within the holder 1.

The spring 7 is disposed in such a manner that breaking of a lead is prevented by absorbing of resulting in motion applied to a lead, when the lead chuck 3 has applied thereof an excessive pressure in the use of the pencil. The sleeve 5 is also provided with the another spring 6 mounted about lead chuck 3 and provided to actuate the aforementioned lead storing cylinder 2 in the return direction.

Now, assuming that the knocked portion (not shown) in the end of the lead storing cylinder 2 is pushed, the lead storing cylinder 2 is moved to a direction against the actuating force of the spring 6 to open the lead chuck 3, and the lead 1*b* projects out of the tip of the cap 1*a* to a in the predetermined length. In the condition of writing operation, if excessive lead pressure is added thereto, the sleeve 5 is moved backward through the lead chuck 3 against the actuating force of the spring 7. Accordingly, the excessive lead pressure is absorbed resiliently so that breaking of a lead will be prevented.

However, since this prior art construction requires that the sleeve 5 be formed out of a metal pipe in which the spring 7 is provided, some defects arise due to difficulties in manufacture and assembly and also result in high material costs.

SUMMARY OF THE INVENTION

The object of the present invention is to provide a propelling pencil, in which the number of parts is decreased and the efficiency of assembly thereof is increased so that the pencil can be produced at a reduced cost while providing improved operation over prior art constructions.

According to an aspect of this invention, there is provided a propelling pencil comprising a lead pipe which is inserted in an outer cylinder and which has a lead chuck at the end portion thereof, a chuck-fastening tube of fastening the lead chuck, and a cushion sleeve which comes into contact with the chuck-fastening tube, which is slidable relative to said outer cylinder, and which is urged by a spring, wherein said cushion sleeve has a cushion portion which can be resiliently deformed to absorb excessive writing pressure.

PREFERRED EMBODIMENT OF THE INVENTION

Hereinafter there will be described detail embodiments of this invention by way of the accompanying drawings.

Figure 1:
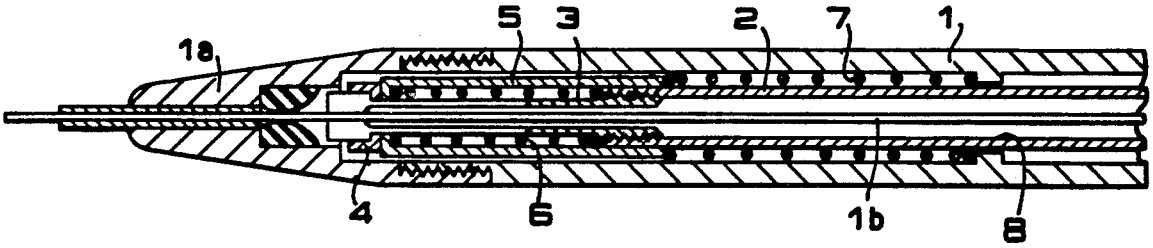
FIG. 1 (PRIOR ART)
FIG. 1 is a sectional view showing major portions of a conventional propelling pencil provided with a protect function free from breaking of a lead.
Figure 2:
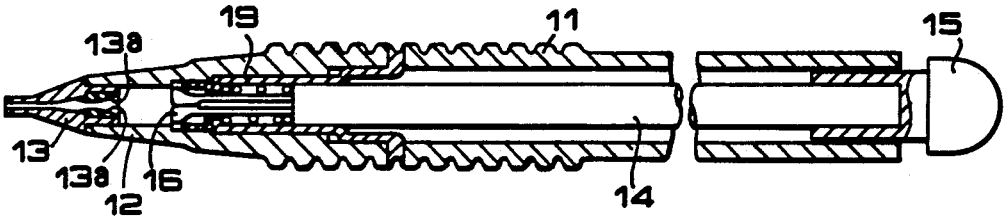
FIG. 2 is a vertical section view showing a propelling pencil according to an embodiment of the present invention.
Figure 3:
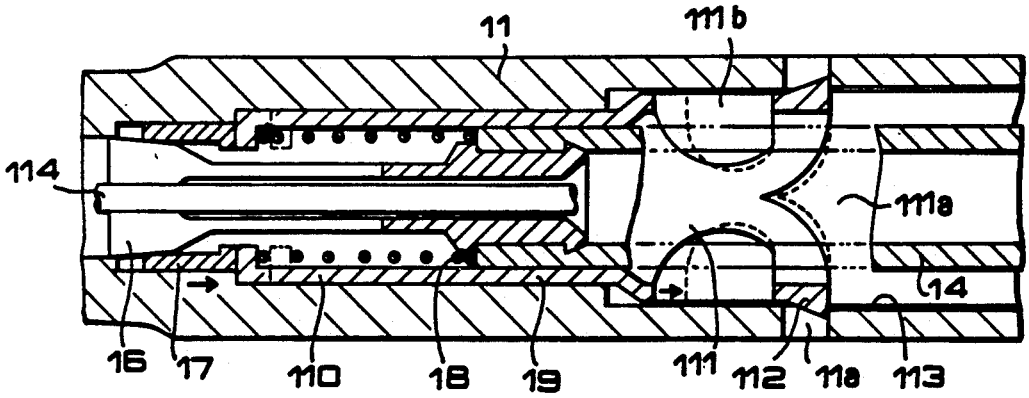
FIG. 3 is a vertical section view showing major portions in FIG. 2.

Referring to FIGS. 2 and 3, an outer cylinder 11 is molded up to a portion of tip fitting 12 as a unitary structure. A guide portion 13 is fitted to the end of the outer cylinder 11, and a lead pipe 14 is accommodated in the outer cylinder 11 to slide in the axial direction.

A knock portion is detachably attached to the rear end of the lead pipe 14, and a lead chuck 16 is fitted to the other end of the lead pipe 14. The end of the lead chuck 16 penetrates through a hole formed in the center of a chuck-fastening tube 17 which has a ]-shape in cross section. The rear end of the chuck-fastening tube 17 is brought into contact with the front end of a cushion sleeve 19 which is slidable in the outer cylinder 11 in the axial direction, and which is forwardly urged by a spring (resilient member) 18.

Figure 4A:
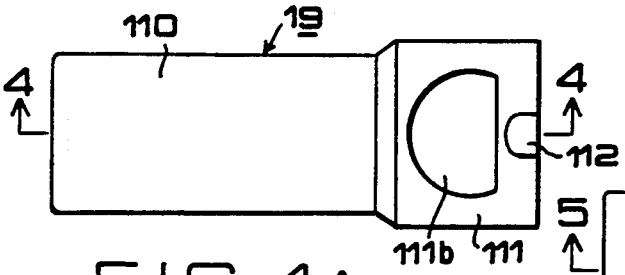
FIG. 4A is a plan view showing a cushion sleeve of FIG. 2.
Figure 4B:
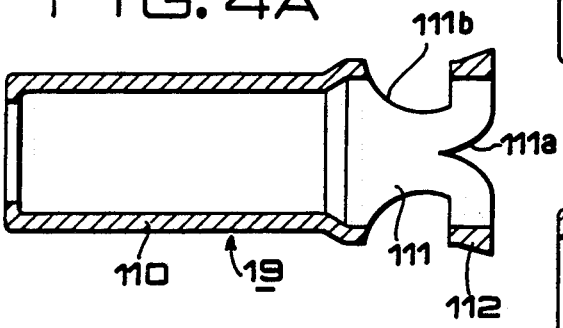
FIG. 4B is a sectional view illustrated at 4—4 line of FIG. 4A.
Figure 5A:
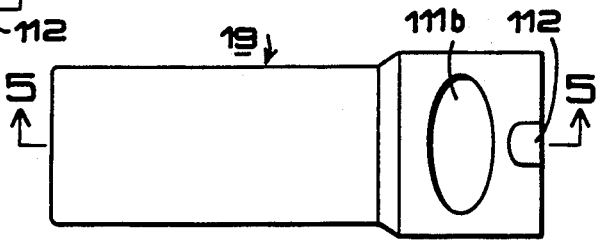
FIG. 5A, FIG. 6A and FIG. 7A are plan views showing other embodiments for the cushion sleeve.
Figure 5B:
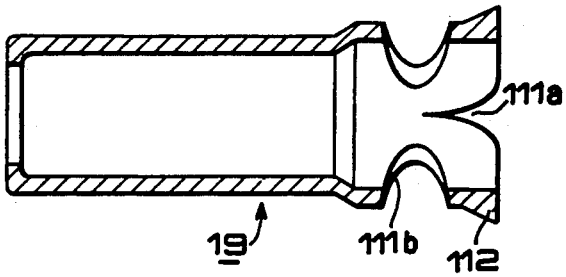
FIG. 5B, FIG. 6B and FIG. 7B are sectional views illustrated respectively at 5—5 line, 6—6 line and 7—7 line corresponding to FIG. 5A, FIG. 6A and FIG. 7A.
Figure 6A:
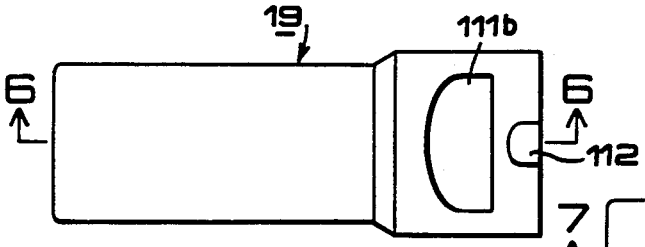
Figure 6B:
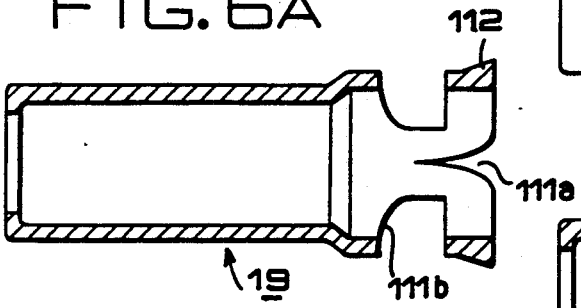
Figure 7A:
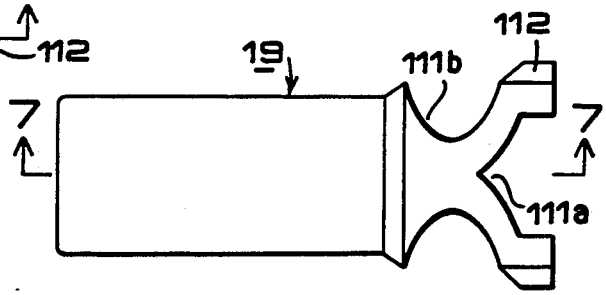
Figure 7B:
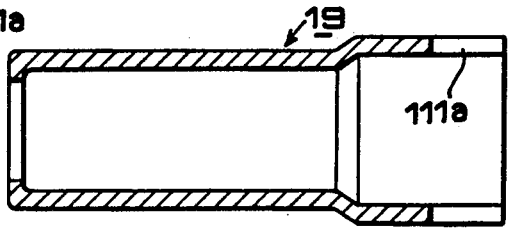
Figure 8A:
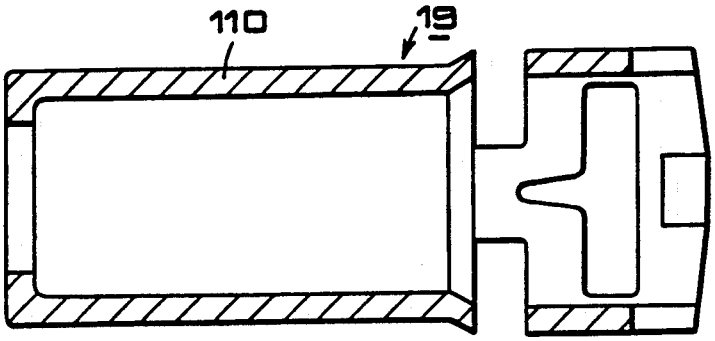
FIG. 8A is a vertical section view showing another embodiment of the cushion sleeve.
Figure 8B:
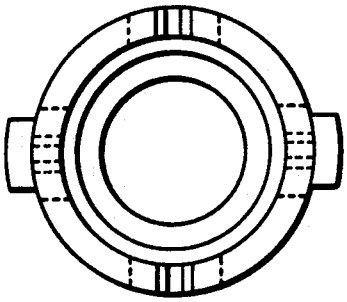
FIG. 8B is a side view showing the cushion sleeve of FIG. 8A.
Figure 9A:
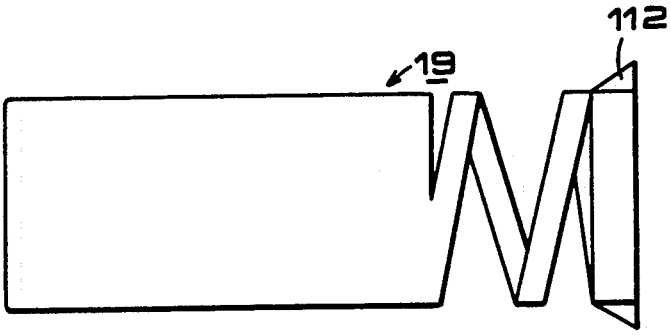
FIG. 9A is a plan view showing the last embodiment of the cushion sleeve.
Figure 9B:
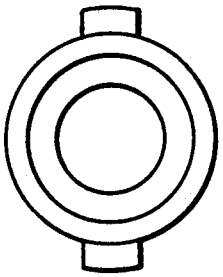
FIG. 9B is a side view showing the cushion sleeve of FIG. 9A.

The cushion sleeve 19 constitutes one of the important elements of this invention, and is composed of an elastic material which can be elastically deformed. As shown in FIGS. 3 and 4, furthermore, the cushion sleeve 19 consists of a sleeve portion 110 and a cushion portion 111 which is molded together with the sleeve portion 110 as a unitary structure, and which can be retractably stretched in the axial direction. The cushion sleeve 19 is secured to the outer cylinder 11 via its engaging projections 112 which engage with stopper holes 11*a* in the outer cylinder 11. Reference number 13*a* depicts a lead guide made of rubber.

As shown in FIGS. 3 and 4, furthermore, a slit 111*a* is formed in the cushion portion 111 of the cushion sleeve 19, so that the cushion portion 111 is deflected in the radial direction, and the engaging projections 112 are reliably engaged with the stopper holes 111*a* in the outer cylinder 11. Further, the cushion portion 111 has a diameter greater than that of the sleeve portion 110 and further has a hole 111*b* formed in the circumferential direction so that it can be retractably stretched in the axial direction. As will be mentioned later, therefore, a second spring is not required to urge the sleeve forward, enabling the assembling operation to be greatly simplified, and the number of parts to be reduced.

FIGS. 5 to 9 illustrate the cushion sleeve 19 according to another embodiment in which the shape and construction of the slit 111*a* and hole 111*b* are modified such that the cushion sleeve 19 reliably engages with the stopper hole 11*a* in the outer cylinder 11 and retractably stretches in the axial direction. The engaging projection 112, slit 111*a*, and hole 111*b* may be constructed in any form provided the cushion portion 111 can be effectively deformed.

Figure 10A:
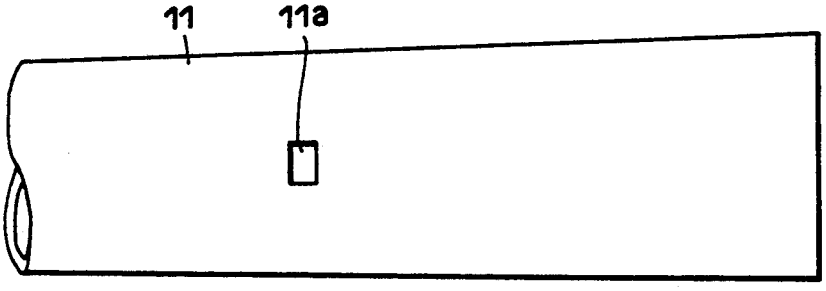
FIG. 10A is a plan view showing an outer cylinder around a stopper hole.
Figure 10B:
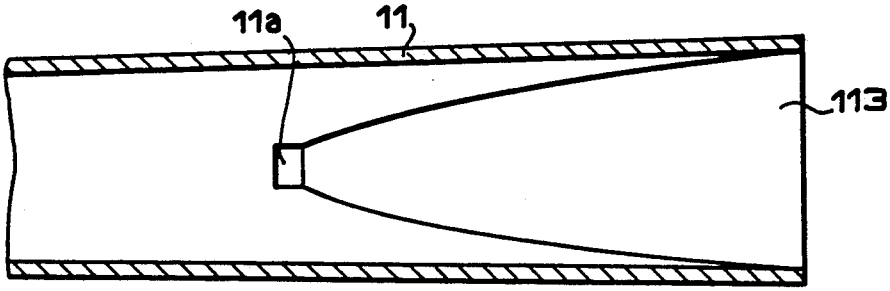
FIG. 10B is a vertical section view on the basis of FIG. 10A.

The stopper hole 11*a* for engagement with the engaging projection 112 of the cushion sleeve 19 is so formed as to penetrate through the peripheral wall of the outer cylinder 11 as shown in FIGS. 2, 3 and 10. Further, a sleeve guide groove 113 is formed in the inner wall of the outer cylinder 11 along the axial direction as shown in FIG. 10B. When the lead-propelling mechanism consisting of lead pipe 4, lead chuck 16 and cushion sleeve 19, is to be installed from the rear end of the outer cylinder 11, the sleeve guide groove 113 works to reliably bring the engaging projection 112 into engagement with the stopper hole 11*a* forward in the outer cylinder 11. For this purpose, the sleeve guide groove 113 stretches from the stopper hole 11*a* to the rear end of the outer cylinder 11. Here, however, the sleeve guide groove 113 may be formed only in the vicinity of the stopper hole 11*a* to fully exhibit its function for guiding the engaging projection 112.

Operation of the invention and the order of assembling will be mentioned below.

First, the cushion sleeve 19 and the cushion portion 111 have been formed as a unitary structure. Therefore, the lead-propelling mechanism can be inserted into the outer cylinder enabling the efficiency of operation to be enhanced. Further, since a second spring is not required to absorb excessive writing pressure, the number of parts is reduced, and the pencil can be cheaply manufactured.

Further, since the lead-propelling mechanism is inserted from the rear end of the outer cylinder 11, the outer cylinder 11 may be molded as a unitary structure up to the portion of tip fitting 12 thereof. Accordingly, the operation efficiency is increased, the number of parts is reduced, and the manufacturing cost is reduced. As required, furthermore, the outer cylinder 11 can be formed as a unitary structure up to the guide portion 13. In this case, the operation efficiency can be further increased to reduce the manufacturing cost.

In carrying out the assembling operation, the engaging projection 112 of the cushion sleeve is reliably and simply brought into engagement with the stopper hole 11*a* of the outer cylinder 11 since the sleeve guide groove 113 has been formed in the inner wall of the outer cylinder 11. Owing to this engagement, furthermore, the position of the cushion sleeve 19 is properly set.

In the propelling pencil which is completely assembled as explained above, the spring 18 for knocking as well as the cushion portion 111 have a small modulus of elasticity so as to absorb excessive writing pressure, and the cushion portion 111 of the cushion sleeve 19 contracts as indicated by a dotted line in FIG. 3 when an excessively great writing pressure is exerted on the lead 114. That is, the lead 114 retracts into the outer cylinder 11, and is not broken.

Figure 11:
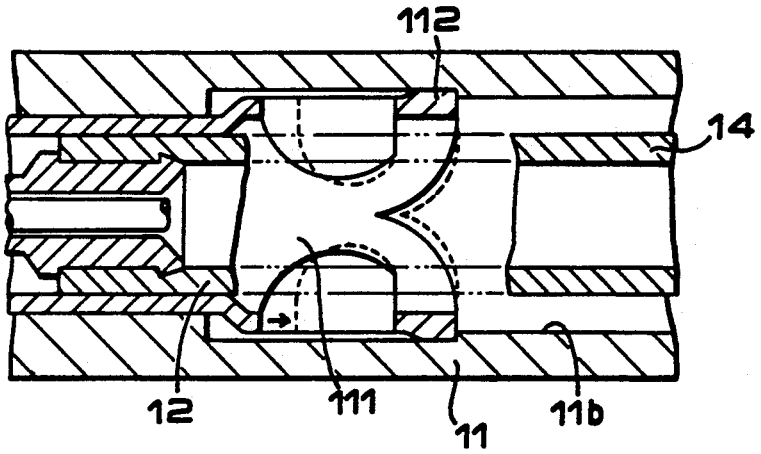
FIG. 11 is a vertical section view showing major portions of the propelling pencil according to the other embodiment of the present invention.

FIG. 11 shows an engaging portion of the engaging projection 112 according to another embodiment of this invention, in which the engaging projection 112 of the cushion sleeve 19 is brought into engagement with a stepped portion 11*b* in the inner wall instead of the stopper hole 11*a*.

This embodiment exhibits the same effects as those of the above-mentioned embodiment. In this embodiment, however, the outer cylinder 11 can be produced more simply since there is no need of forming the stopper hole 11*a* and the sleeve guide groove 113.

In the case of this embodiment, however, it is desired that the tip fitting 12 and the guide portion 13 of FIG. 2 be formed separately from the outer cylinder 11.

According to this invention as explained above, the sleeve has a spring function for absorbing excessively great writing pressure. Furthermore, the assembling efficiency can be increased strikingly, and the number of parts can be reduced to remarkably decrease the manufacturing cost.

Figure 12:
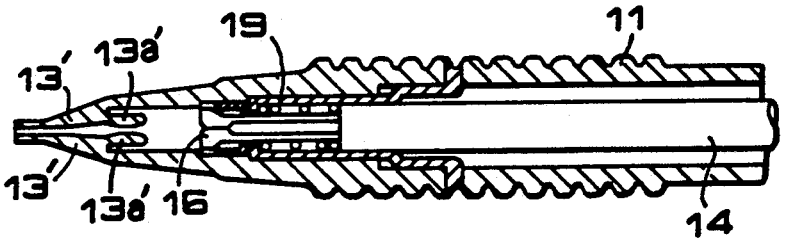
FIG. 12 is a vertical section view showing tip portions of the propelling pencil according to still another embodiment of the present invention.

FIG. 12 is a vertical section view showing tip portions of the propelling pencil according to a still further embodiment of this invention. As compared with the propelling pencil of the embodiment in FIG. 2, that of FIG. 12 is provided with an outer cylinder 11 united with the tip fitting 13' and a lead guide portion 13*a'*.

This structure makes it easier to automatically assemble the propelling pencils.

What is claimed is:

1. A pencil comprising:

(a) an outer cylinder;

(b) a lead pipe accommodated in said outer cylinder and having a lead chuck at a distal end thereof;

(c) a chuck tightening pipe mounted in said outer cylinder and, in assembly, tightening said lead chick;

(d) an axially slidable cushion sleeve mounted in said outer cylinder and including:

(i) a first elongated portion, having a first outer diameter, adapted to engage said chuck tightening pipe, (ii) a second elongated cushioning portion, having a second outer diameter, connected to said first elongated portion, said second elongated cushioning portion having a rear end remote from said first elongated portion, (iii) an engaging projection extending radially outward of said second portion at said rear end, (iv) a diametric slit formed in said rear end of said second portion and extending substantially transverse to said radially extending engaging projection, said diametric slit permitting radial resilient deflection of said rear end of said second portion in a direction substantially transverse to said diametric slit, and (v) a circumferential hole formed in said second portion in front of said engaging projection, said circumferential hole permitting axial resilient deflection of said second portion, said slit, said hole and said second portion cooperating to form a resilient elastically deformable spring;

(e) said outer cylinder including engagement means for engaging said projection for limiting the axial movement of said cushion sleeve;

(f) said outer cylinder including guide means for guiding said at least one projection into engagement with said engagement means during assembly; and (g) spring biasing means interposed between said lead pipe and said first portion.

2. A pencil according to claim 1, wherein said engagement means of said outer cylinder comprises one of a stopper hole extending through said outer cylinder or a recessed portion formed in an inner wall of said outer cylinder.

3. A pencil according to claim 1, wherein said guide means of said outer cylinder comprises a slit formed in an axial direction in an inner wall thereof, said slit guiding said engaging projection of said cushion sleeve into said engagement means of said outer cylinder.

4. A pencil according to claim 1, wherein said cushioning position is integrally connected to said elongated portion.

5. A pencil according to claim 1, wherein said second outer diameter is greater than said first outer diameter.

* * * * *